US011342111B2

(12) United States Patent
Konishi

(10) Patent No.: US 11,342,111 B2
(45) Date of Patent: May 24, 2022

(54) IGNITION COIL FOR INTERNAL COMBUSTION ENGINE AND MANUFACTURING METHOD THEREOF

(71) Applicant: DENSO CORPORATION, Kariya (JP)

(72) Inventor: Atsuyuki Konishi, Kariya (JP)

(73) Assignee: DENSO CORPORATION, Kariya (JP)

( * ) Notice: Subject to any disclaimer, the term of this patent is extended or adjusted under 35 U.S.C. 154(b) by 734 days.

(21) Appl. No.: 16/318,821

(22) PCT Filed: Jun. 8, 2017

(86) PCT No.: PCT/JP2017/021385
§ 371 (c)(1),
(2) Date: Jan. 18, 2019

(87) PCT Pub. No.: WO2018/016218
PCT Pub. Date: Jan. 25, 2018

(65) Prior Publication Data

US 2019/0189341 A1 Jun. 20, 2019

(30) Foreign Application Priority Data

Jul. 21, 2016 (JP) ..... JP2016-143275

(51) Int. Cl.

| | |
|---|---|
| ***H01F 27/32*** | (2006.01) |
| ***H01F 38/12*** | (2006.01) |
| ***F02P 15/00*** | (2006.01) |
| ***F02P 3/055*** | (2006.01) |
| ***H01F 27/02*** | (2006.01) |
| ***H01F 27/24*** | (2006.01) |

(Continued)

(52) U.S. Cl.
CPC ..... *H01F 27/327* (2013.01); *F02P 3/055* (2013.01); *F02P 15/00* (2013.01); *H01F 27/022* (2013.01); *H01F 27/24* (2013.01); *H01F 27/28* (2013.01); *H01F 38/12* (2013.01); *H01F 41/127* (2013.01)

(58) Field of Classification Search
USPC ..... 336/59, 60, 96, 131, 198
See application file for complete search history.

(56) References Cited

U.S. PATENT DOCUMENTS 5,241,941 A 9/1993 Hancock et al.
5,685,065 A * 11/1997 Suzuki ..... H01F 38/12 123/634

(Continued)

FOREIGN PATENT DOCUMENTS

HU T70770 A 11/1995
JP 56-16922 2/1981

(Continued)

*Primary Examiner* — Shawki S Ismail
*Assistant Examiner* — Kazi S Hossain
(74) *Attorney, Agent, or Firm* — Nixon & Vanderhye P.C.

(57) ABSTRACT

A first filler resin is disposed to cover at least an outer peripheral side of a secondary spool and a secondary coil. The second filler resin is filled inside a case and seals a cover sealant which includes a primary coil, secondary spool, a secondary coil, a center core, an outer core and the first filler resin. The connector protrudes to an outside of the case. The case has a fixing portion. The second filler resin has a lower elasticity than the first filler resin. The ignition coil is manufactured by filling the first resin inside the case, and filling the second resin after the first resin is cured.

19 Claims, 12 Drawing Sheets

(51) Int. Cl.
*H01F 27/28* (2006.01)
*H01F 41/12* (2006.01)

(56) References Cited

U.S. PATENT DOCUMENTS

| | | | | |
|---|---|---|---|---|
| 6,196,209 | B1 * | 3/2001 | Shimada | F02P 3/02 123/634 |
| 2002/0057179 | A1 * | 5/2002 | Shimada | H01F 38/12 336/208 |
| 2005/0134416 | A1 * | 6/2005 | Maekawa | H01F 38/12 336/92 |
| 2013/0291844 | A1 * | 11/2013 | Skinner | H01F 27/022 123/634 |
| 2016/0365194 | A1 * | 12/2016 | Skinner | F02P 9/002 |

FOREIGN PATENT DOCUMENTS

| | | | | |
|---|---|---|---|---|
| JP | 5-175058 | | 7/1993 | |
| JP | 2000-216034 | | 8/2000 | |
| JP | 2003-158019 | | 5/2003 | |
| JP | 2003158019 | A * | 5/2003 | |
| JP | 2008-199720 | | 8/2008 | |
| JP | 2012-174829 | | 9/2012 | |
| JP | 2012174829 | A * | 9/2012 | |
| JP | 2014-096473 | | 5/2014 | |
| JP | 5616922 | B2 * | 10/2014 | H04N 5/04 |
| JP | 2014-212222 | | 11/2014 | |

* cited by examiner

IGNITION COIL FOR INTERNAL COMBUSTION ENGINE AND MANUFACTURING METHOD THEREOF

CROSS REFERENCE TO RELATED APPLICATIONS

This application is the U.S. National Phase Application under U.S.C. 371 of the International PCT Application PCT/JP2017/021385, filed on Jun. 8, 2017, and published as WO/2018/016218 on Jan. 25, 2018. This application is based on and claims the benefit of priority from Japanese Application No. 2016-143275 filed on Jul. 21, 2016, the entire contents of each of which are incorporated herein by reference.

TECHNICAL FIELD

The present disclosure relates to an ignition coil for an internal combustion engine and a manufacturing method thereof.

RELATED ART

Ignition coils for internal combustion engines include a primary coil and secondary coil magnetically coupled to each other, a metallic core, a case accommodating the above mentioned elements, and a connector which connects the ignition coil to external devices. In the case, a fixing portion is provided to extend to an outside of the case. The ignition coil is thus fixed to the internal combustion engine at the fixing portion. An inside of the case filled with a filler resin, and configuring elements, for example, the primary coil and the secondary coil, sealed inside the case.

An ignition coil disclosed in patent literature 1 however uses different filler resins. That is, a filler resin that is disposed around a secondary coil on an inside of a case and a filler resin provided in other regions inside the case are different. More specifically, the filler resin that is filled around the secondary coil is softer than the filler resin that is provided in the other regions of the case. This configuration aims to prevent cracking of the filler resin that is disposed around the secondary coil, which is caused by thermal stress.

It is noted that the ignition coil disclosed in the patent literature 1 is configured with hard filler resin which is disposed around a core, and a soft filler resin that is packed inside the hard filler resin.

CITATIONS

Patent Literature

Patent Literature 1: JP2014-96473A

However, since the ignition coil disclosed in patent literature 1 has the hard filler resin that is disposed around the core, there is a concern of cracks occurring in the filler resin surrounding the core, caused by thermal stress. That is, the core tends to have a lower linear expansion coefficient than the filler resin and a higher hardness than the secondary coil. For this reason, thermal stress acting on the filler resin from the core tends to become larger than thermal stress acting on the filler resin from the secondary coil. As a result, there is a concern of filler resin that is disposed around the core cracking, as opposed to the filler resin surrounding the secondary coil.

The ignition coil of the patent literature 1 is configured with the soft filler resin disposed inside the hard filler resin. For this reason, a structure that includes the filler resin, configuring elements accommodated inside a case, and the case is therefore strongly formed. When the ignition coil is however fixed to an internal combustion engine at a fixing portion, vibrations from the internal combustion engine are easily transmitted from the fixing portion to a connector. If the vibrations is applied at the connector, there is a concern that the vibrations will adversely affect electrical connections between external devices that are connected to the connector.

SUMMARY

The present disclosure aims to provide an ignition coil for an internal combustion engine in which cracking of a filler resin inside a case is suppressed, and transmission of vibrations from a fixing portion to a connector are decreased. The present disclosure also relates to a manufacturing method of the ignition coil.

A first aspect of the present disclosure is an ignition coil for an internal combustion engine.

The ignition coil includes a primary coil, a secondary coil that is wound around a secondary spool being disposed on an outer side of the primary coil, a center core that is disposed on an inner side of the primary coil and the secondary coil, an outer core which is disposed on an outer side of the primary coil and the secondary coil, and a high voltage output section outputting a voltage from the secondary coil to an outside and having conductivity. The ignition coil also includes a case accommodating the primary coil, the secondary coil, the secondary spool, the center core, the outer core and the high voltage output section, a first filler resin that is filled inside a part of the case to cover at least an outer peripheral side of the secondary coil that is wound on the secondary spool, and a second filler resin that is filled inside the case and seals a cover sealant. The cover sealant includes the primary coil, the secondary coil, the secondary spool, the center core, the outer core and the first filler resin a connector which extends towards an outside of the case. The case includes a fixing portion being fixed to an internal combustion engine, and the second filler resin covering the outer core, and having a lower elasticity than the first filler resin.

Another aspect of the present disclosure is a manufacturing method of the ignition coil for an internal combustion engine. That is, the first filler resin is filled inside the case, and the second filler resin is filled after the first filler resin is cured.

According to a configuration of the ignition coil for an internal combustion engine, the second filler resin seals the cover sealant which includes the outer core, and thus a filler resin that is in close contact with the outer core is the second filler resin. The second filler resin has a lower elasticity than the first filler resin. Therefore, thermal stress that is caused by a difference in a linear expansion coefficient of the second filler resin and the outer core can be adsorbed by conformational change of the second filler resin. As a consequence, cracks occurring in the filler resin can be suppressed around the outer core where thermal stress is a concern.

The second filler resin seals the cover sealant that includes the first filler resin. A structure of the case that is formed of components accommodated inside the case which include the first filler resin and the second filler resin and the case has a degree of softness. As a result, even when the ignition coil is fixed to an internal combustion engine at the fixing portion, vibrations of the internal combustion engine transmitting from the fixing portion to the connector are hindered and therefore decreased. More specifically, since the structure that is formed of the components accommodated inside the case and the case is formed to have a degree of softness, vibration is thus damped when being transmitted toward the connector from the fixing member.

Additionally, a filler resin that is filled into a region on an outer side of the secondary coil being wound on the secondary a spool is different from a filler resin that is filled into other regions of the case. Also, flexibility in selecting a type of the first filler resin, which is disposed around the secondary coil that is wound around the secondary spool, is enhanced. For example, according to the configuration, a resin that is disposed in the region around the secondary coil having a high voltage can be formed from a material which has higher insulating properties than a resin which is provided in other regions inside the case. In this way, a resin can be packed and disposed around an area of the secondary coil according to a usage, of the ignition coil.

The manufacturing method of the ignition coil for an internal combustion engine entails filling the first filler resin inside the case, and then filling the second filler resin after the first filler resin is cured. When the first filler resin receives thermal stress from the second filler resin at a time of curing, residual strain, for example, occurring on the first filler resin once the first filler resin is set can be prevented.

According to the mode described above, an ignition coil for an internal combustion engine, in which cracking of the filler resin inside the case is prevented and the transmission of vibrations from the fixing member to the connector is reduced, and a manufacturing method of the ignition coil can be provided.

BRIEF DESCRIPTION OF DRAWINGS

The purpose of the present disclosure, and other purposes, features and advantages will become clear with a detailed description which is provided hereafter with reference to the drawings.

In the accompanying drawings.

EMBODIMENTS OF THE DISCLOSURE

First Embodiment

An ignition coil for an internal combustion engine will be described with reference to FIGS. 1 to 4.

Figure 1:
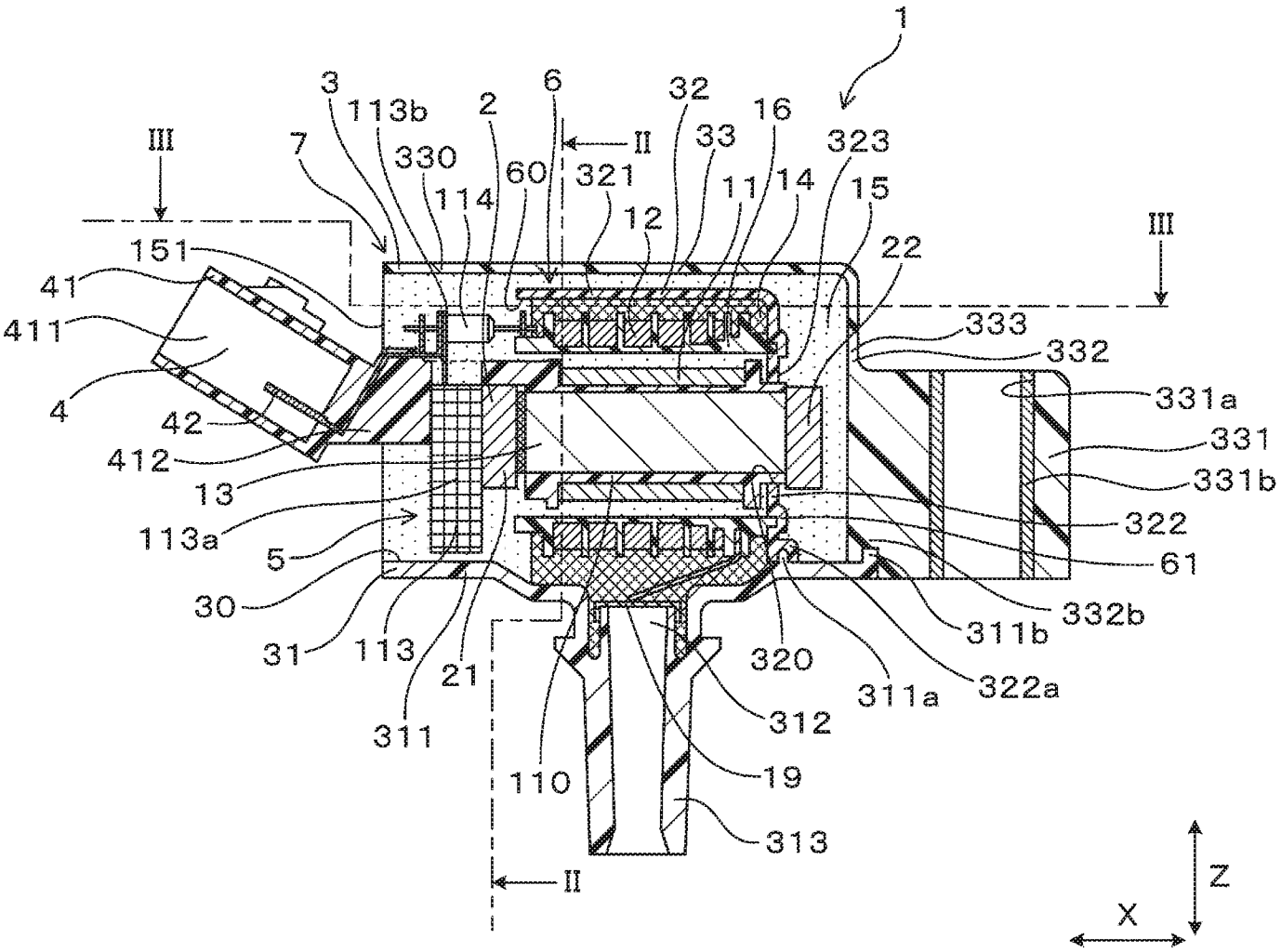
FIG. 1 is a cross sectional diagram of an ignition coil for an internal combustion engine, according to a first embodiment.

As shown in FIG. 1, the ignition coil 1 for an internal combustion engine of a first embodiment includes a primary coil 11, a secondary coil 12, a center core 13, an outer core 2, a high voltage outputting section, a case 3, a first filler resin 14, a second filler resin 15 and a connector 4.

The secondary coil 12 is wound around a secondary spool 16 which is disposed on an outer peripheral side of the primary coil. The center core 13 is disposed on an inner peripheral side of the primary coil 11 and the secondary coil 12. The outer core 2 is disposed on an outer peripheral side of the first coil 11 and the second coil 12. The high voltage output section 19 has conductivity and externally outputs a voltage from the secondary coil 12. The case 3 accommodates the primary coil 11, the secondary coil 12, the secondary spool 16, the center core 13, the external core 2 and the high voltage output section 19. The first filler resin 14 is filled into a part of a region inside the case 3. The first filler resin 14 is arranged to cover at least the outer peripheral side of the secondary coil which is wound around the spool 16. The filler resin 15 is filled inside the case 3 and seals a cover sealant 5. The cover sealant 5 includes the primary coil 11, the secondary spool 16, the secondary coil 12, the center core 13, the outer core 2 and the first filler resin 14. The connector 4 is provided to protrude outwardly towards an outside of the case 3. It is noted that in the first embodiment, the high voltage output section is a high voltage output terminal 19 which is formed from metal. Hereafter, the high voltage output section is referred to as a high voltage output terminal 19.

Figure 2:
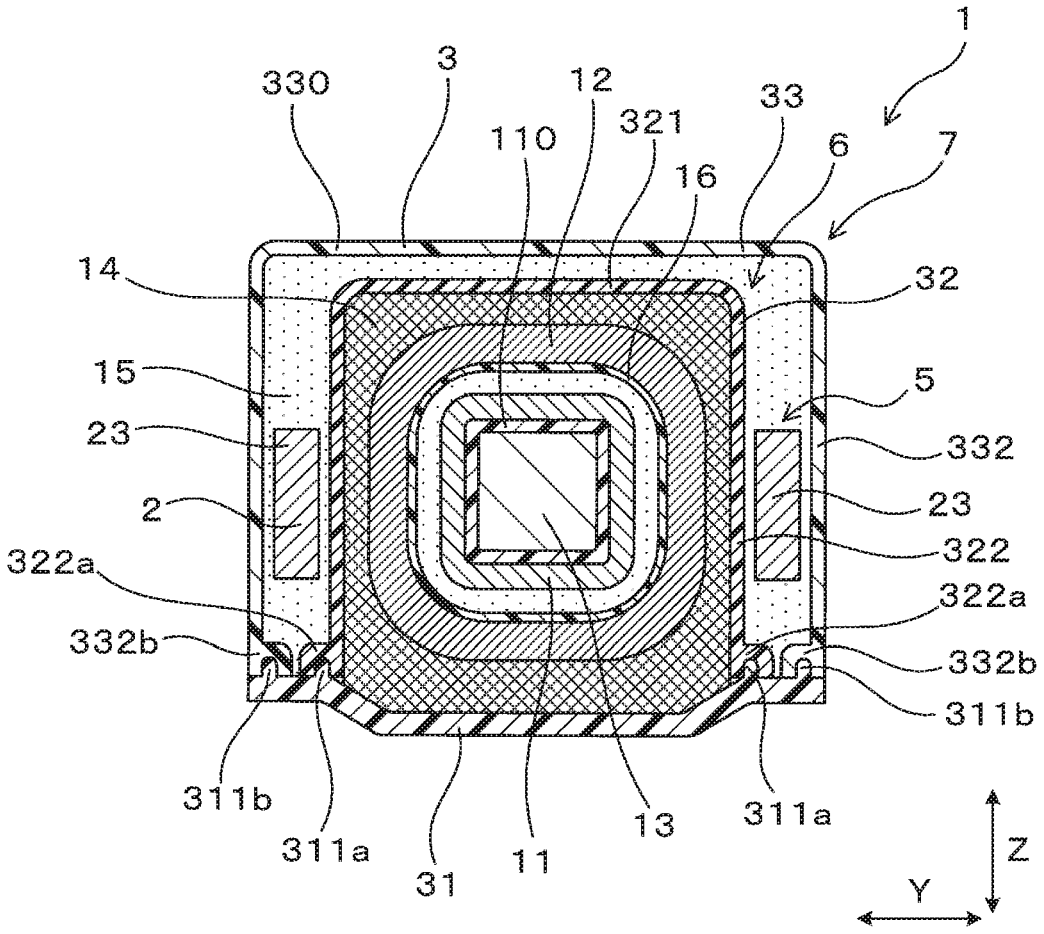
FIG. 2 is a cross sectional diagram of arrows taken across a line II-II in FIG. 1.
Figure 3:
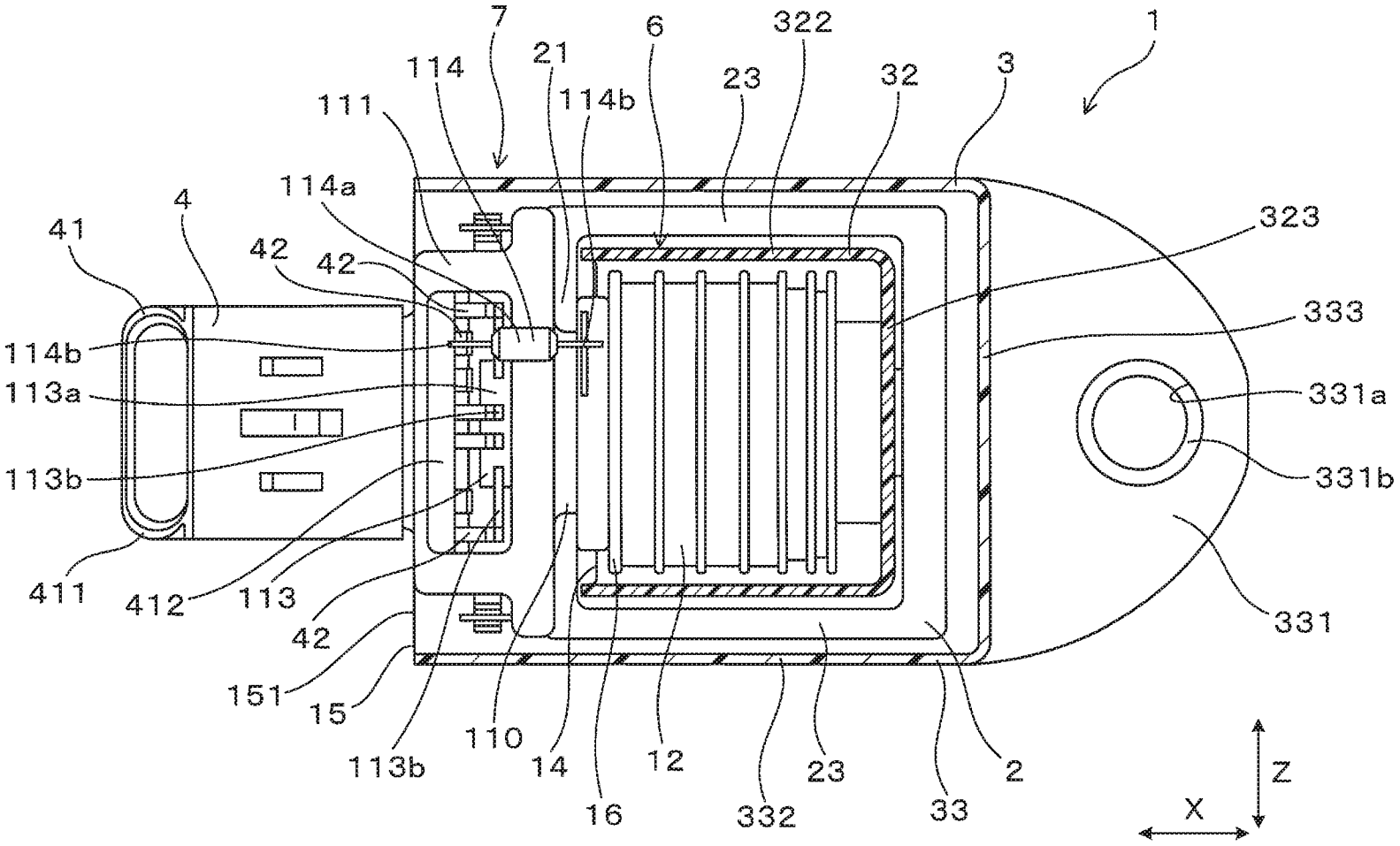
FIG. 3 is a cross sectional diagram of arrows taken across a line III to III in FIG. 1.
Figure 4:
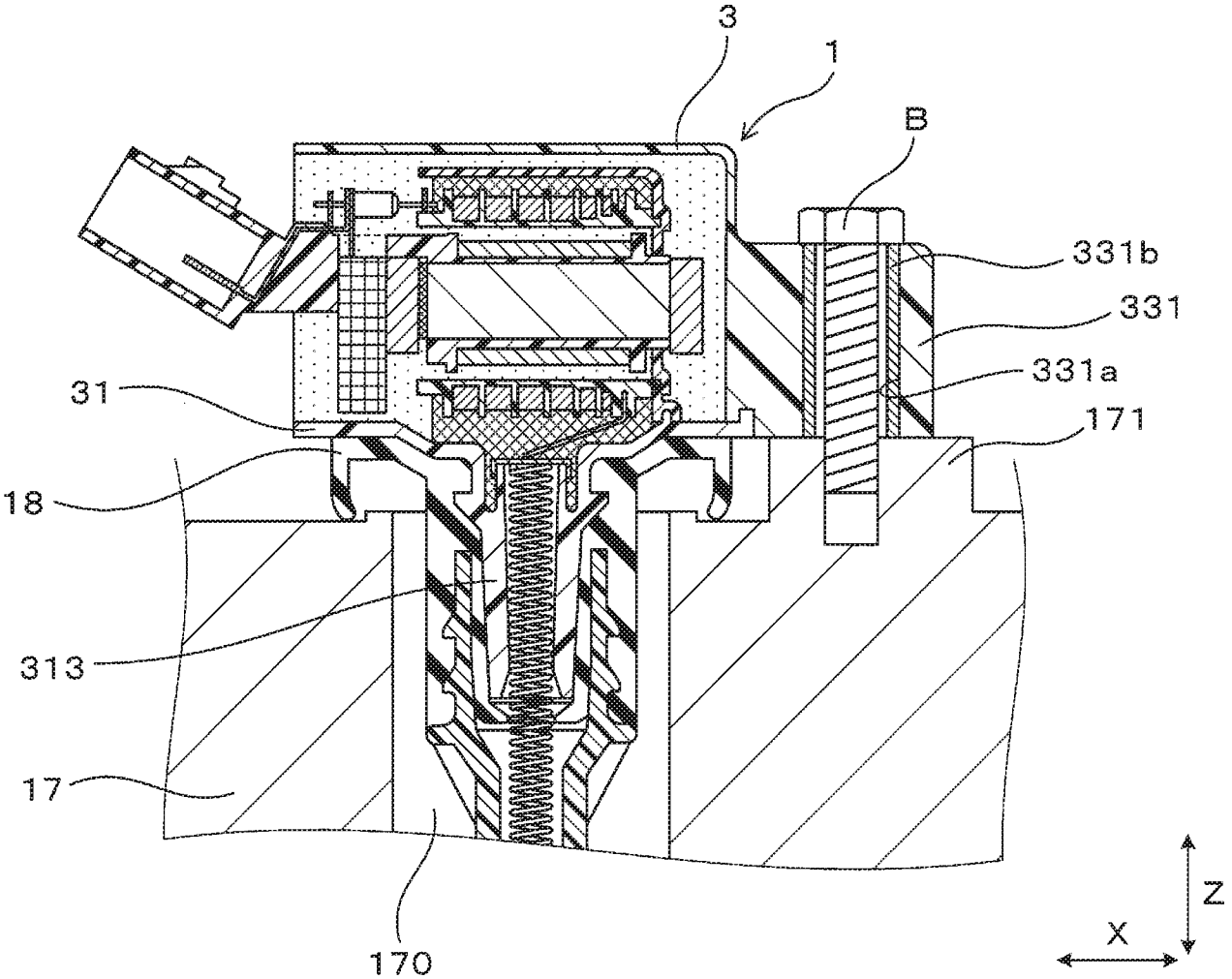
FIG. 4 is a cross sectional diagram showing an attachment structure attaching the ignition coil to an internal combustion engine according to the first embodiment.

As shown in FIGS. 1, 3 and 4, the case 3 includes a fixing portion 331 which is fixed to an internal combustion engine. The second filler resin 15 covers the outer core 2 as shown in FIGS. 1 and 2. The second filler resin 15 has lower elasticity than the first filler resin 14.

In the first embodiment, the second filler resin 15 and the first filler resin 14 contain a thermal curing resin and a filler which has a lower linear expansion coefficient than the thermal curing resin. The second filler resin 15 contains a lower content ratio of the filler than the first filler resin 14. By changing the content ratio of the filler, the elasticity of the respective second filler resin 15 and first filler resin 14 is also changed as described above. In the first embodiment, the thermal setting resin is epoxy resin and the filler is silica.

The ignition coil 1 of the first embodiment can be used in an internal combustion engine of a vehicle or a cogeneration device, for example.

For simplicity, a winding axial direction of the primary coil 11 and the secondary coil 12 are referred to as front and rear direction X hereafter.

A direction that is orthogonal to the front and rear direction is referred to as a vertical direction Z. A direction that is orthogonal to both the front and rear direction X, and the vertical direction Z is referred to as a horizontal direction Y hereafter. One direction of the front and rear direction X is a front part and another direction is a rear part. Additionally, one direction if the vertical direction Z is an upper part, and another direction is referred to as a lower part.

As shown in FIGS. 1 and 2, the case 3 includes a first case 31, a second case 32 and a third case 33. The first case 31 is covers the elements accommodated inside the case 3 from a lower side. In addition to a part of the first case 31, the second case 32 accommodates the secondary spool 16, the secondary coil 12, the high voltage output section 19 and the first filler resin 14. Also, in addition to the first case 31, the third case 33 accommodates the primary coil 11, the secondary spool 16, the secondary coil 12, the first filler resin 14, the center core 13, the outer core 3 and the second filler resin 15, in addition to the part of the first case 31.

The first case 31 includes a bottom wall portion 311 which is formed in a surface direction that is orthogonal to the vertical direction Z. As shown in FIG. 1, the case 3 has an open hole 312 which is formed to penetrate through to the inside of the case 3. The open hole 312, which is provided in a center part of the bottom wall portion 311 of the first case 31, is formed to penetrate through in the vertical direction Z.

The first case 31 includes a tubular shaped high voltage tower section 313 that is formed to extend downwardly towards a lower side from a peripheral area of the open hole 312. A shown in FIGS. 1 and 2, an inner-locking convex section 311*a* and an outer-locking convex portion 311*b* are formed on an upper surface of the bottom wall portion 311. The inner-locking convex portion 311*a* is formed on an inside of the outer-locking convex portion 311*b*. The inner-locking convex section 311*a* is formed to protrude upwardly, towards an upper side from the bottom wall portion 311. The inner-locking convex portion 311*a* is provided to fix the second case 32. The outer-locking convex portion is formed to protrude upwardly, from an end of the bottom wall portion 311 and interlock the third case 33.

The second case 32 includes a second case opposed portion 321 and a second case side portion 322. The second case opposed portion 321 is opposed to the center part of the upper surface of the bottom wall portion 311 of the first case 31 in the vertical direction Z. A shown in FIG. 1, a part of the second case opposed portion 321 is provided to overlap with the open hole 312, in the vertical direction Z. Also, the second case opposed portion 321 has a rectangle plate shape with a side provided along the front and rear direction X, and another side provided along the horizontal direction Y.

The second case side portion 322 is provided to extend downwardly, towards a lower part, from both end sides of the horizontal direction Y of the second case opposed portion 321, and also from a rear end side. That is, the second case side portion extends downwardly to the lower part from the above mentioned three sides. As shown in FIG. 3, a cross sectional shape of the second case side portion 322 is an open letter U shape that is opened towards the front part. That is the cross sectional shape orthogonal to the vertical direction Z of the second case side portion 322 is provided in a letter U shape. An inner-locking concave portion 322*a* is formed on a lower end portion of the second case side portion 322, as shown in FIGS. 1 and 2. The second case 32 is interlocked with the inner-locking convex portion 311*a* of the first case 31, at the inner-locking concave portion 322*a*.

As shown in FIGS. 1 and 2, the third case 33 includes a third case opposed portion 330 and a third case side portion 332. The third case opposed portion 330 opposes a substantial whole of the upper surface of the bottom wall portion 311 of the first case 31, in the vertical directions Z. The third case opposed portion 330 has a rectangular plate shape with sides along the front and rear direction X and sides along the vertical direction Y. The third case side portion 332 is provided to extend downwardly, towards a lower part, from both end sides of the horizontal direction Y of the third case opposed portion 330, and also from a rear end side. That is, the third case side portion 332 extends downwardly to the lower part from the above mentioned three sides.

A cross sectional shape of the third case side portion 332 is an open letter U shape towards the front part thereof, as shown in FIG. 3. That is the cross sectional shape orthogonal to the vertical direction Z of the third case side portion 332 is provided in a letter U shape. As shown in FIGS. 1 and 2, an outer locking concave portion 332*b* is formed on a lower end portion of the third case side portion 332. The third case 33 is thus interlocked with the inner-locking portion 311*a* of the first case 31 at the outer-locking concave portion 332*b*.

As shown in FIGS. 1 and 3, a part of the second case side portion 322 is also referred to as a second case rear portion 323, which is extended to the lower side from a side of a rear end of the second case opposed portion 321. Additionally, a part of the third case side portion 332 is also referred to as a third case rear portion 33 that is a wall section which is extended to the lower side from a side of a rear end of the third case opposed portion 330.

As shown in FIGS. 1 and 3, a fixing portion 331 is formed on the third case 33. The fixing member 331 is formed to extend towards the rear part from the third case rear-portion 333. A bolt through-hole 331*a* which penetrates in the vertical direction Z is formed on the fixing member 331. A metal cylindrical shaped bush 331*b* is interlocked into the bolt through-hole 331*a*.

The ignition coil 1 of the first embodiment is mounted by inserting the high voltage tower section 313 into a plughole 170 of a cylinder 17, as shown in FIG. 4. A boss portion 171 is formed on the cylinder head 17 to bolt and fasten the ignition coil 1 thereto. A bolt B is inserted inside the bush 331*b* of the fixing portion 331, and the ignition coil 1 is bolted and fixed to the cylinder head 17 by threading the bolt B into a thread-hole of the cylinder head. It is noted that a rubber seal 18 which is formed from rubber is disposed between the first case 31 of the ignition coil 1 and the cylinder head 17. As a result, sealing is provided between the ignition coil 1 and the cylinder head 17.

As shown in FIG. 1, the case 3 has an open section 30 that opens to a different side from the side onto which the fixing portion 331 is mounted. In the first embodiment, the case 3 includes the open section 30 which opens to a side that opposes another side onto which the fixing portion 331 is mounted. Specifically, according to the first embodiment, the case 3 is opened to the front part. The case 3 forms an external shape, and an outer case body 7 that is formed from the first case 31 and the third case 33 has the open section 30. In this first embodiment, an inner case body 6 that is formed from the first case and the second case 32 has a front open portion 60. The front open portion 60 is opened towards the front part.

As shown in FIGS. 1 to 3, the secondary spool 16 is disposed on an inner-side of the inner-case body 6. The secondary spool 16 is formed in a tubular shape from a resin. The secondary coil 12 is wound around an outer surface of the secondary spool 16. A rear end of the secondary spool 16 is interlocked with a cylindrical concave portion 61 of the second case 32, as shown in FIG. 1. The cylindrical concave portion 61 is formed in a cylindrical shape on a second case rear portion 323, so that the rear end of the secondary spool 16 can interlock therewith.

As shown in FIGS. 1 and 2, according to the first embodiment, the outer side of the secondary spool 16 and the secondary coil 12 provided on the inner side of the inner case body 16 is filled with the first filler resin 14. The secondary coil is thus sealed by the first filler resin 14. Also in the first embodiment, an inner peripheral side of the secondary spool 16 is not filled with the first filler resin 14.

It is noted that the open hole 312 of the first case 31 is provided with the high voltage output terminal 19 that is formed of a metal and interlocks therewith. The high voltage output terminal 19 thus covers the open hole 312. The open hole 312 of the first case 31 is thus closed, such that 1 first filler resin 14 will not leak from the open hole 312 to outside the case 3. In FIG. 3, only an outline of the first filler resin 14 is shown.

As shown in FIGS. 1 and 2, the secondary coil 11 is positioned on an inner side of the secondary spool 16. The primary coil 11 and the secondary coil 12 are positioned to overlap each other in a coaxial form. Furthermore, the ignition coil 1 includes a primary spool 110 for the winding of the primary coil. The connector 4 and the primary spool 110 are formed as one body.

The primary spool 110 is formed in a rod shape. As shown in FIG. 1, a through-hole 320 is formed on the second case rear portion 323 of the second case to penetrate in the front and rear direction X. A rear end portion of the primary spool 110 is inserted into the through-hole 320 of the second case rear-portion 323 and provided to extend to the rear part from the through-hole 320.

On the connector 4, a wire harness terminal connector used to electrically connect external devices to the ignition coil 1, for example. As shown in FIGS. 1 and 3, the connector 4 is provided to extend from the side that opposes the other side on which the fixing portion 331 is mounted. That is, the connector 4 is provided to extend towards the front part.

The connector 4 has a connector housing 41 and a plurality of terminal members 42. The connector housing 41 is resin. The connector housing 41 includes a tubular shape portion 411 and an extended portion 412. The tubular shape portion 411 is formed in a tubular shape and configured to project to the front part. The tubular shape portion 411 is arranged on the outside of the case 3. The extended portion 412 is provided to extend to an inner side of the case 3 from the tubular shape portion 411. Parts of the element members 42 are embedded in the in the extended portion 412.

The terminal members 42 include an outside terminal that is projected from the extended portion 412 to an inside of the tubular shaped portion 411, and an inside terminal that projects from the extended portion 412 to the inner-side of the case 3. The respective outside terminal and the inside terminal mentioned here are ground terminals, power terminals to connect an external power switch and the primary coil 11, or signaling terminals that transfer a switching signal to an igniter 113 described in detail hereafter, for example, connected to the connector 4 via a wire harness.

As shown in FIG. 3, the connector 4, and the first spool 110 are connectedly joined by a joining portion 111 and thus form the one body. The joining part 111 is extended from the extended portion 412 to the rear part, and also from a front end of the primary spool 110 to the front part. The connector housing 41, the primary spool 110, and the joining portion 11, thus configure the one body formed by resin.

The center core 13 is disposed on the inner side of the primary spool 110 as shown in FIGS. 1 and 2. The center core 13 is formed as flat plate shaped steel board of soft magnetic material laminated in plurality, in a thickness direction thereof. The center core 13, as a whole, has a substantially rectangular column shape that is formed length wise in the front and rear direction X. The primary spool 110 is formed with the center core 13 inserted on an inner side thereof. As shown in FIG. 1, a front end-surface and a rear end-surface of the center core 13 are exposed from the primary spool 110.

As shown in FIGS. 1 to 3, the outer core 2 is disposed to surround the center core 13 on both sides of the front and the rear direction X, and both sides of the horizontal direction Y. The outer core 2 includes a front opposed side portion 21, which opposes the front part, relative to the center core 13, and a rear opposed side-portion 22, which opposed the rear part, relative to the center core 13. As is also shown in FIG. 3, the outer core 2 joins end portions which are provided on both sides of the front opposed side portion 21 and the rear opposed side portion 22 of the horizontal direction Y, and is provided with a pair of joining side portions 23, as shown in FIG. 3. The outer core 2 is an annular rectangular shaped steel plate, which is provided in plurality in the thickness direction. As shown in FIG. 3, the outer core 2, as a whole, is formed as a rectangular frame shape that has an opening configured in the vertical direction Z.

The outer core 2 is arranged on an outer side of the second case 32, when viewed in the vertical direction Z. The outer core 2 is provided with the front opposed side portion 21 positioned lower than the joining part 111.

As shown in FIGS. 1 and 3, an igniter 113 is provided between the front opposed side portion 21 and the connector 4. The igniter 113 supplies and shuts off electricity to the primary coil. The igniter 113 includes an igniter body **113*a* that has an inbuilt switching element and an igniter terminal 113*b* that protrudes from the igniter body 113*b*. The igniter terminal 113*b* is connected to an inside terminal of the connector 4**.

In the first embodiment, the igniter 113 is arranged with a main rear surface of the igniter body **113*a* opposed to the front opposed side portion 21, in the front and rear direction X. The igniter 113 is provided with the main surface of a front part of the igniter body 113*a* opposed to a rear surface of the extended portion 412 of the connector 4, in the front and rear direction X. Also, a position of the igniter 113 is decided by the connector housing 41 of the connector 4, the joining portion 111 and the primary spool 110, which are formed as the one body, and also by the primary spool 110 and the opposed side-portion 21 of the outer core. The igniter 113 is intervened between the rear surface of the extended portion 412 of the connector 4 and a front surface of the opposed front surface 21. According to the configuration, the position of the igniter 13 may be precisely decided by the primary spool 110 and the connector 4 which is formed as one body with the primary spool 110**.

The igniter 113 is connected to the primary coil 11 via the terminal members 42 which configure the power terminal of the connector 4. Specifically, the igniter 113, the primary coil 11 and the terminal members 42 of the connector 4 are electrically connected to each other. As a result, it is necessary to increase a precision of relative positions between these elements. In this view, as described hereinabove, since the positions between the respective igniter 113, the primary spool 110 and the connector 4 can be precisely decided, an electrical connection between the primary coil 11 that is wound around the primary spool 110, and the terminal members 42 of the connector 4 can be provided with high precision.

The igniter 113 forms a unit with the outer core, the primary spool 110 and the connector 4. As a result, since the second filler resin, which covers this unit, decreases the vibrations, transmission of vibrations to the terminal members 42 of the connector 4, connection point connected to the igniter terminal 113*b*, and connection point connected to the terminal members 42 of the connector 4 and the primary coil 11 can be suppressed, when the vibrations are transmitted from the fixing portion 331 to the ignition coil 1.

Additionally, an applied load is decreased to the locations connecting to the terminal members 42 of the connector 4 and the igniter terminal 113*b*, and the locations connecting to the terminal members 42 of the connector 4 and the primary coil 11. According to the above configuration, electrical conductivity between the igniter 113, the connector 4, and the primary coil 11 can be thus enhanced.

As shown in FIGS. 1 and 3, a diode 114 is disposed on an upper part of the igniter 113. As shown in FIG. 3, the diode 114 includes a diode body 114*a* which has an inbuilt element and a pair of leads 114*b* that protrude from the diode body 114*a*. According to the first embodiment, the diode body 114*a* is arranged in a length wise direction, in the front and rear direction X. Among the pair of leads 114*b*, one lead is connected to one end of the secondary coil 12, and another lead is connected to an earth terminal member 42 among the terminal members 42 of the connector 4. The diode 114 suppresses a voltage which is generated at the secondary coil 12 when electricity is supplied to the primary coil 11. It is noted that a connection between the diode 114 and the secondary coil 12 is omitted from the Figs.

As shown in FIG. 1, the igniter 113 and the diode 114 are provided on an outside of the first filler resin 114, in the first embodiment.

As shown in FIG. 1, on the inside of the case 3, the second filler resin 15 is filled in regions that surround the cover sealant 5 that includes the primary spool 110, the primary coil 11, the secondary spool 16, the secondary coil 12, the center core 13, the outer core 2, the igniter 113, the diode 114 and the first filler resin 14. The third case 33 and the cover sealant 5 are separated from each other as shown in FIGS. 1 and 2. The second filler resin 15 is provided between the third case 33 and the cover sealant 5. The second filler resin 15 is provided on the outer side of the second case 32, on an inner side of the third case 33.

In the first embodiment, the second filler 15 is also provided on the outer peripheral side of the primary spool 110 and the primary coil 11, which are provided on the inner peripheral side of the secondary spool 16 and the secondary coil 12. The secondary spool 16 and the secondary coil 12 are disposed on the inner side of the inside case 6. The primary resin 14 is not in contact with a surface of the outer core 2. It is noted that only an outline of the second filler resin 15 is shown in FIG. 3.

As shown in FIG. 1, the second filler resin 15 includes an exposed surface 151 that is exposed from the open section 30 of the case 3 to the outside of the case 3. The connector 4 is configured to extend from the exposed surface 151. In the first embodiment, the connector 4 extends from the exposed surface 151 to the front part. A part of the connector 4 is in close contact with the second filler resin 15. In the first embodiment, the exposed surface 151 is formed around a whole periphery of the connector 4. The connector 4 is in contact with the second filler resin 2 around a whole periphery of the extended portion 412. The connector 4 is configured to extend from a center part of the open section 30 to the outside of the case 30.

Next, an example of a manufacturing method of the ignition coil 1 for an internal combustion engine of the first embodiment will be described, with reference to FIGS. 1, and 5 to 7.

Figure 5:
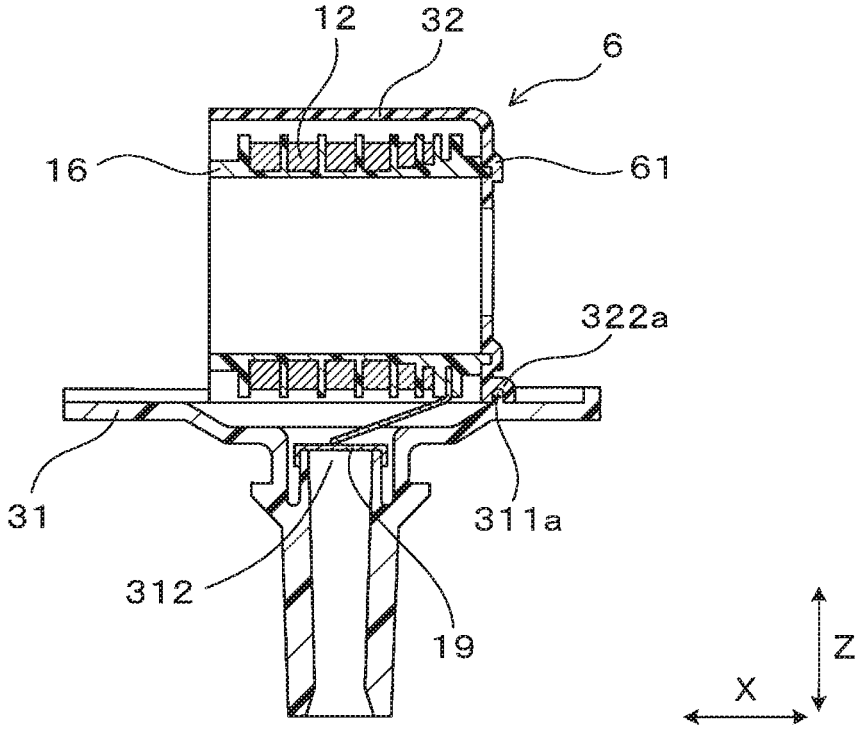
FIG. 5 is cross sectional diagram to describe a manufacturing method of the ignition coil which shows a state before filling an inside of a side case body with a first filler resin according to the first embodiment.

As shown in FIG. 5, the inner-locking concave portion 322*a* of the second case 32 is interlocked with the inner-locking concave portion 311*a*, as shown in FIG. 5. The inner case body 6 is thus configured. The high voltage output terminal 19 locks an upper end of the high voltage tower section 313, to cover the open hole 312 of the first case 31. Next, the rear end of the secondary spool 16 which has the secondary coil 12 wound thereon is locked into the cylindrical concave portion 61 of the second case 32.

Figure 6:
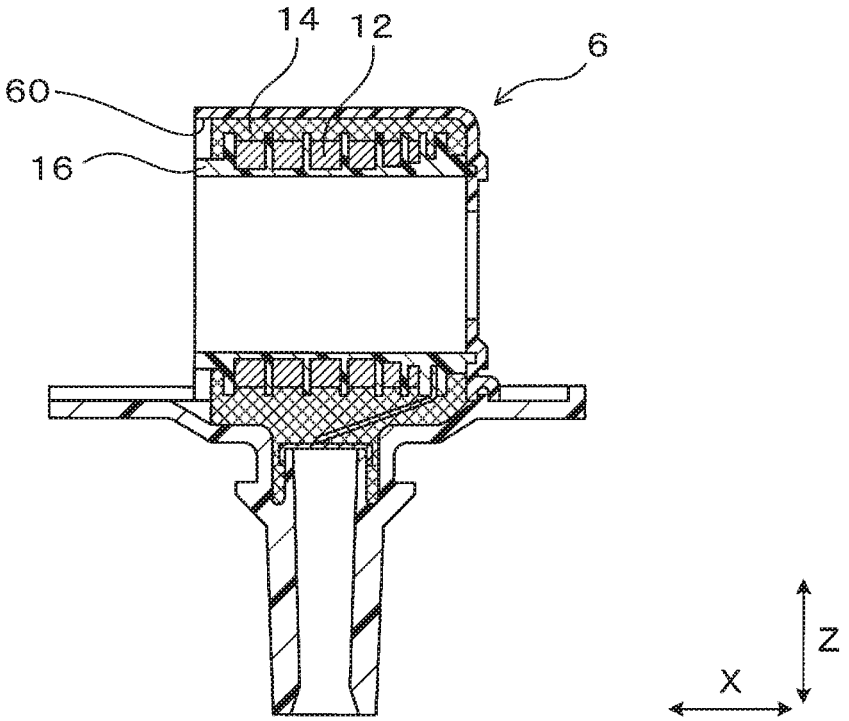
FIG. 6 is cross sectional diagram that describes the manufacturing method of the ignition coil which shows a state immediately after filling the inside of the side case body with the first filler resin according to the first embodiment.

As shown in FIG. 6, the first filler resin 14 is disposed to fill a space around the inner case 6, the secondary coil 12 and the secondary spool 16. The first filler resin 14 is filled inside the side case 6 from the front open portion 60. The first filler resin 14 is filled close to the vicinity of the front open portion 60. As this point, since the open hole 312 of the first case 31 is covered and closed off by the high voltage output terminal 19 as described above, leaking of the first filler resin 14 from the open hole 312 of the first case 31 is avoided. That is, the high voltage output terminal 19 that outputs the voltage increased by the secondary coil 12 to an outside of the ignition coil 1 is also used as a cover seal for the open hole 312 of the first case 31. The first filler resin 14 is heated and cured.

Figure 7:
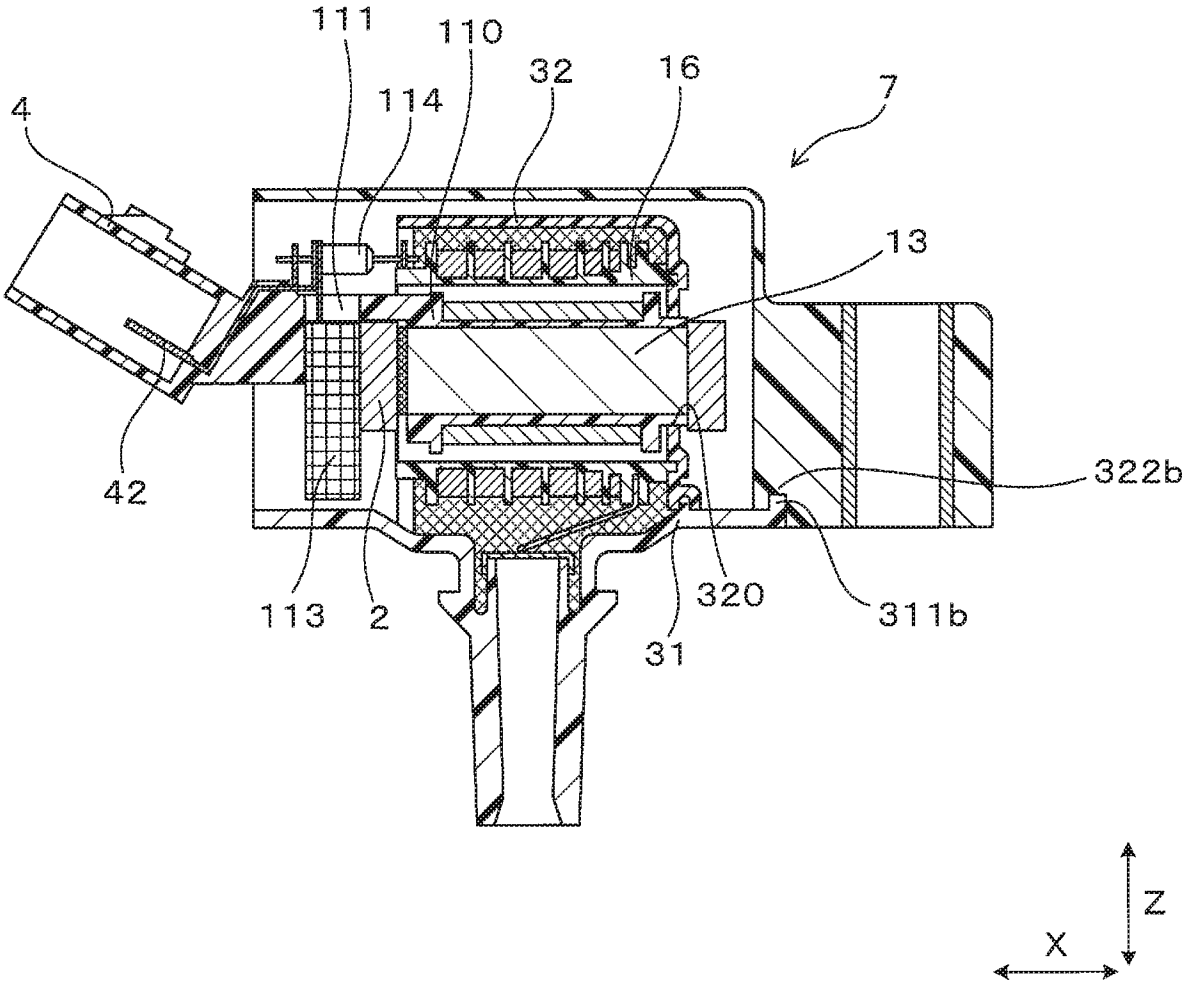
FIG. 7 is cross sectional diagram describing the manufacturing method of the ignition coil that shows a state of an inside of a case immediately before filling an inside of the case with a second filler resin, according the first embodiment.

As shown in FIG. 7, a module body is configured of the outer core 2, the igniter 113 and the diode 114, for example, which are arranged and mounted on single body component that is formed from the connector 4 provided with the terminal members 42 buried on an inside thereof, the primary spool 110 provided with the center core 13 buried on an inside thereof and the joining portion 111. This module body is then inserted into the inner side of the secondary spool 16, and the rear end portion of the primary spool 110 of the module body is inserted into the through-hole 320 of the second case 32.

The outer-locking convex portion 311*b* of the first case 31 is interlocked with the outer-locking concave portion 322*b* of the third case 33. The outer case 7 is thus configured.

As shown in FIG. 1, the second filler resin 15 is provided to fill an inside of the outer case 7 from the open section 30. Specifically, the first filler resin 14 is filled the inside of the case 3, and after the first filler resin 14 is cured the second filler resin 15 is filled. The second filler resin 15 is filled to the open section 30 of the outer case 7.

Next the effects of the first embodiment will be described.

According to the first embodiment, the second filler resin 15 seals the cover sealant 5 that includes the outer core 2. Therefore, the second filler resin 15 is a filler resin that is in close contact with the outer core 2. The second filler resin 15 has lower elasticity than the first filler resin 14. Thermal stress that is caused by the difference in the linear expansion coefficient between the second filler resin 15 and the outer core 2 can thus be adsorbed by deformation of the second filler resin 15. Furthermore, cracking of the filler resin due to thermal stress can be suppressed around the outer core 2. A risk of failure or dysfunction of the ignition coil caused by progression of cracks to an inside of the filler resin may also be decreased.

The second filler resin 15 covers the cover sealant 5 that includes the first filler resin 14. Accordingly, components accommodated inside the case 3, including the second filler resin 15 and the first filler resin 14, and the structure which is formed of the case 3 are formed to have a level of softness. As a result, even when the ignition coil 1 is fixed to the cylinder head 17 at the fixing portion 331, it is difficult for the vibrations of the cylinder head 17 to be transmitted from the fixing portion 331 to the connector 4. That is, since the structure of the components accommodated inside the case 3 and the case 3 itself is formed with a level of softness, the vibrations decrease as they progress from the fixing portion 331 towards the connector 4. According to the configuration, reliability of electrical connection between the components inside the ignition coil can be increased.

Also, a resin that is filled in outer peripheral regions of the secondary coil 12 that is wound around the secondary spool 16 is a different from a resin filled in other regions of the case 3. Accordingly, a type of resin that is used for the first filler resin 14 is selectable with higher flexibility. That is, the first filler resin that is disposed around the secondary coil 12 on the secondary spool 16 can be selected with enhanced flexibility. As a further result, the resin that is provided in regions around the secondary coil 12, with high voltage, and the high voltage output terminal 19 can be formed from material that has higher insulating properties than the resin provided in the other areas of the case 3.

In this way, according to the purpose of use, the resin can be filled around the areas of secondary coil 12 and the high voltage output terminal 19.

The connector 4 is exposed from the exposed surface 151. Specifically, at least one part of the connector 4 is in contact with the second filler resin 15. As a result, the second filler resin 15 can directly adsorb the vibrations of the connector 4. Also, in the first embodiment, the exposed surface 151 is formed around the whole peripheral area of the connector 4. That is, the connector 4 is in-contact with the second filler resin 15 at the whole peripheral area thereof. As a result, an effect of the adsorption of the vibrations from the connector by the second filler resin 15 can be further enhanced.

The connector 4 and the primary spool 110 are formed as the one body. Therefore, a decrease in the number components and process steps taken to assemble the ignition coil 1 is achieved. In the first embodiment, the second filler resin 15 is provided between the third case 33 and the cover sealant 5. That is, the second filler resin 15 is intervened between the third case 33 on which the fixing portion 331 is formed and the primary spool 110 that configures the cover sealant 5. Also, even when the vibrations of the cylinder head 17 are transmitted from the fixing portion 331 to third second case 33, further transmission of these vibrations from the third case 33 to the primary spool 110 can be suppressed. As a result, the vibrations from the connector 4, which is formed as the one body with the primary spool 110, are suppressed.

The connector 4 is provided to extend from the side which opposes the other side on which the fixing portion 331 is mounted. A lengthened distance can be further secured between the fixing portion 331 and the connector 4, and vibrations can be further decreased due to the second filler resin 15. An increase in the size of the ignition coil 1 can be suppressed in the horizontal direction Y, orthogonal to the front and rear direction X, in which the fixing portion 331 and the connector 4 are arranged. However, since the connector 4 is provided to extend from the side which opposes the other side on which the fixing portion 331 of the case 3 is provided, when the fixing portion 331 and the connector 4 vibrate as one body, the fixing portion 331 is a fixed end of the vibration, and the connector 4 is a free end of the vibration. There is a concern of the connector 4 vibrating as a consequence. However, as described herein above, the second filler resin 15 seals the cover seal 5 that includes the first filler resin 14, therefore transmission of vibrations from the fixing portion 331 to the connector 4 is suppressed.

In the first embodiment, the increase in the size of the ignition coil 1 in the horizontal direction Y is suppressed while suppressing the vibrations occurring at the connector 4.

The second filler resin 15 and the first filler resin 14 contain the thermal curing resin and the filler. The content ratio of the filler contained in the second filler resin 15 is lower than the content ratio of the filler contained in the first filler resin 14. Hence, the second filler resin 15 and the first filler resin 14 can be produced by changing the content ratios of filler resin while have the same main substance. The productivity of the ignition coil 1 is thus enhanced.

The case 3 includes the first case 31, the second case 32 and the third case 33. According to the configuration, the regions that are filled by the first filler resin 14 can be separated by a part of the first case 31 and the second case 32, and the regions that are filled by the second filler resin 15 can also be separated by the first case 31 and the third case 33. A process of filling the respective first filler resin 14 and the second filler resin 15 inside the case 3 can also be simplified.

The fixing member 331 is formed on the third case 33. Additionally, the third case 33 and the cover sealant 5 are separated from each other, and the second filler resin 15 is provided between the third case 33 and the cover sealant 5. As a result, if vibrations of the cylinder head 17 are transmitted from the fixing portion 331 to the third case 33, further transmission of these vibration from the third case 33 to the accommodated components inside the third case 3 can be suppressed. As a result, reliability of the ignition coil 1 can be increased.

The high voltage output terminal 19 covers the open hole 312 of the first case 31. The high voltage output terminal 19 can have a role of outputting a voltage that increased by the secondary coil 12 to the outside of the ignition coil 1 and also a role of a sealing material of the open hole 312 of the first case 31.

The manufacturing method for the ignition coil 1 of the first embodiment entails filling the first filler resin 14 inside the case 3, and filling the second filler resin 15, after the first filler resin 14 is cured. For this reason, when the first filler resin 14 is cured, a situation of the first filler resin 14 receiving thermal stress from the second filler resin 15, and residual strain of the first filler resin 14 occurring, after the first filler resin 14 is cured can be suppressed.

As described hereinabove, according to the first embodiment, the ignition coil for an internal combustion engine in which cracking of the filler resin occurring inside the case is suppressed, and vibrations transmitting from the fixing portion to the connector is suppressed, and the manufacturing method thereof can be provided.

Second Embodiment

Figure 8:
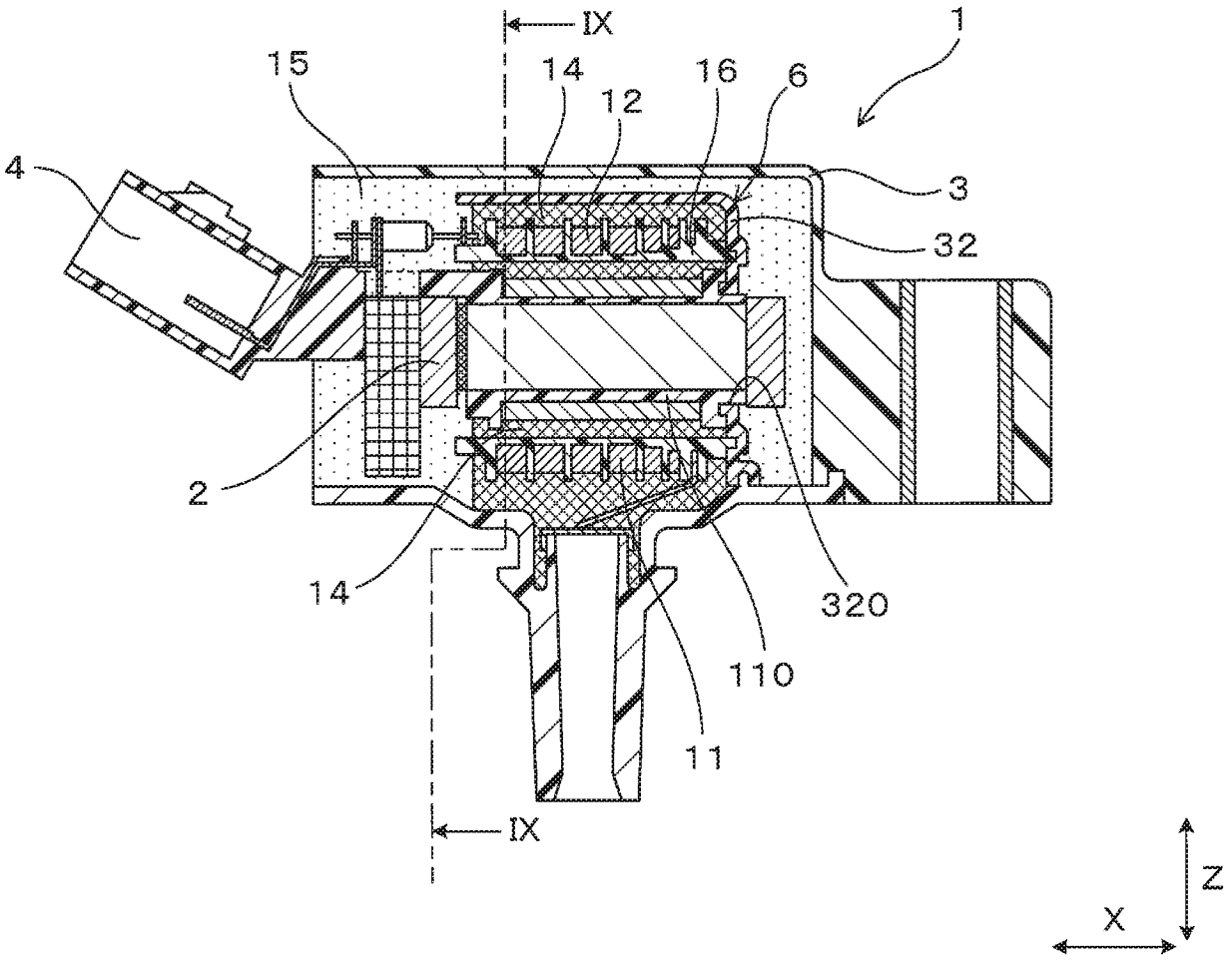
FIG. 8 is a cross sectional diagram of the ignition coil for an internal combustion engine, according to a second embodiment.
Figure 9:
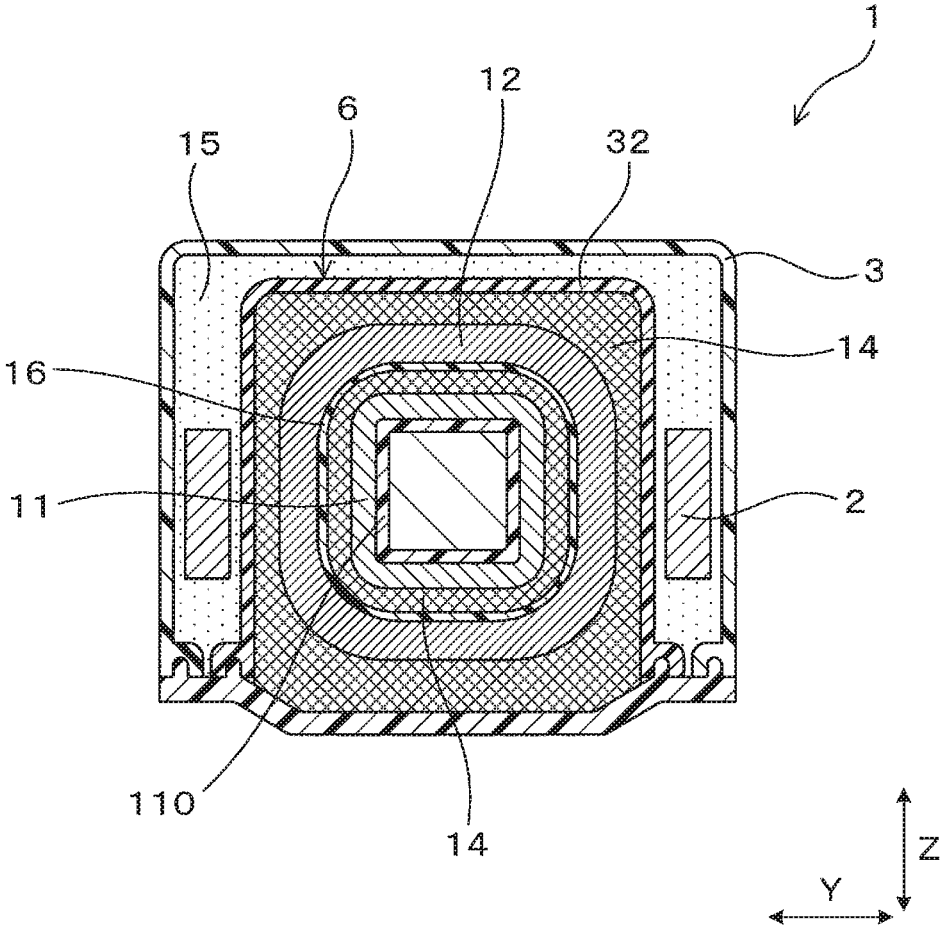
FIG. 9 is a cross section diagram along arrows taken across a line IX to IX of FIG. 8.

In a second embodiment, filling regions inside the case 3 of the first filler resin 14 are different from the first embodiment, as shown in FIGS. 8 and 9. Specifically, in the second embodiment, the first filler resin 14 is filled into the inner side of the secondary spool 16 and the secondary coil 12 that is provided on the inside of the inner case 6, and also into the outer peripheral side of the primary spool 110 and the primary coil 11. As shown in FIG. 8, in the second embodiment, a configuration in which, a rear part of the primary spool 110 and a part that surrounds the through-hole 320 of the second case 32 that can be interlocked with each other, is provided. By interlocking the primary spool 110 and the second case 31, sealing between the primary spool 110 and the second case 32 is achieved, and leaking of the first filler resin 14 from the inner case 6 is thus avoided.

Other aspects of the second embodiment are the same as the first embodiment. It is noted that symbols of earlier embodiments that are also used in following embodiments indicate the same configuring element, unless specified otherwise. The effects of the second embodiment are the same as the first embodiment.

Third Embodiment

Figure 10:
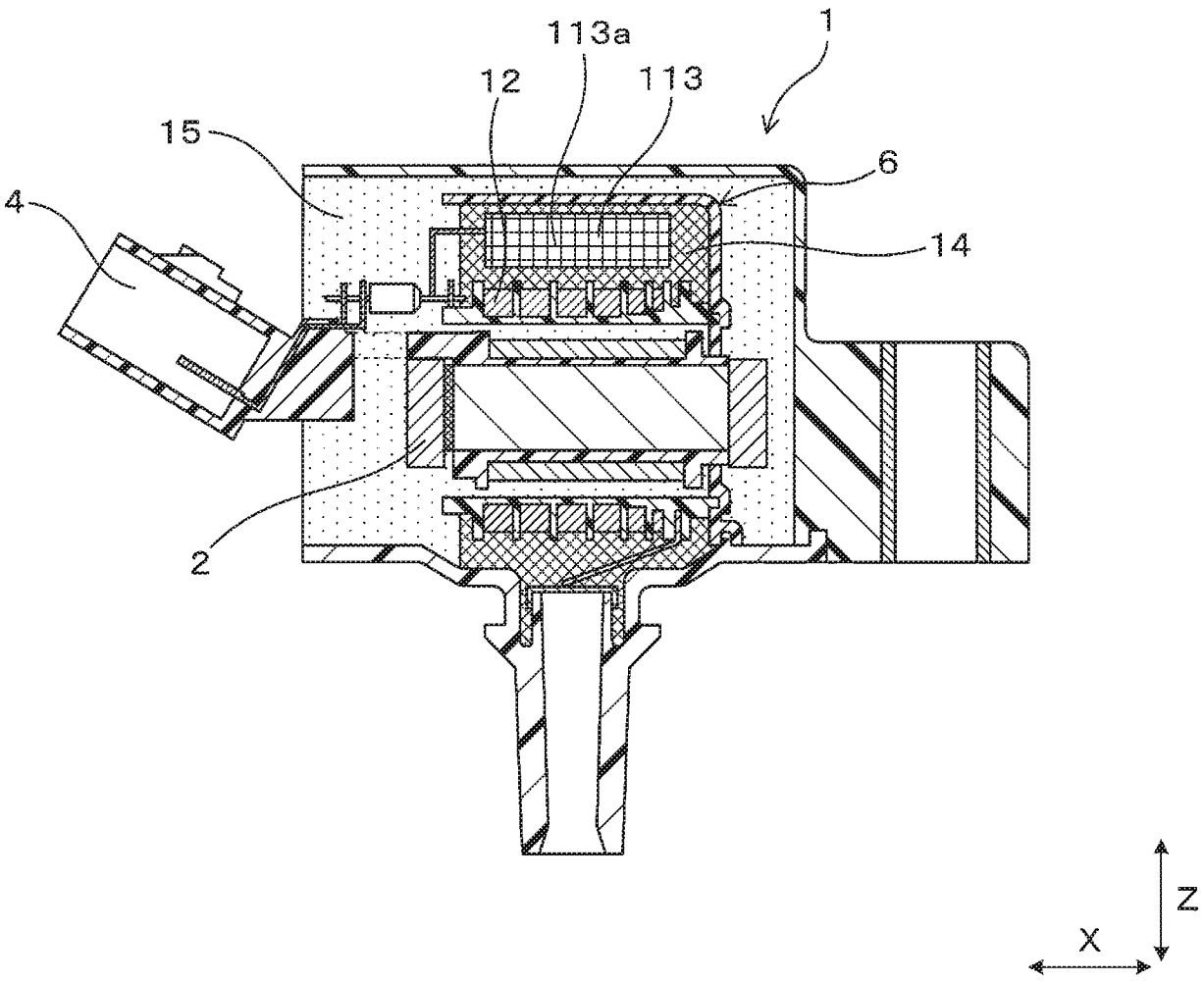
FIG. 10 is a cross sectional diagram of the ignition coil for an internal combustion engine, according to a third embodiment.

In a third embodiment, a disposed position of the igniter 113 is different from the first embodiment, as shown in FIG. 10. In the third embodiment, the igniter 113 is arranged on the inside of the inner case 6. The igniter 113 is also buried inside the first filler resin 14. The igniter 113 is provided on an upper side of the secondary coil 12. That is, the igniter 113 is positioned to have the main surface of the igniter body 113*a* opposed to the secondary coil 12, in the vertical direction Z.

Other aspects of the third embodiment are the same as the first embodiment. The same effects of the first embodiment may also be obtained in the third embodiment.

Fourth Embodiment

Figure 11:
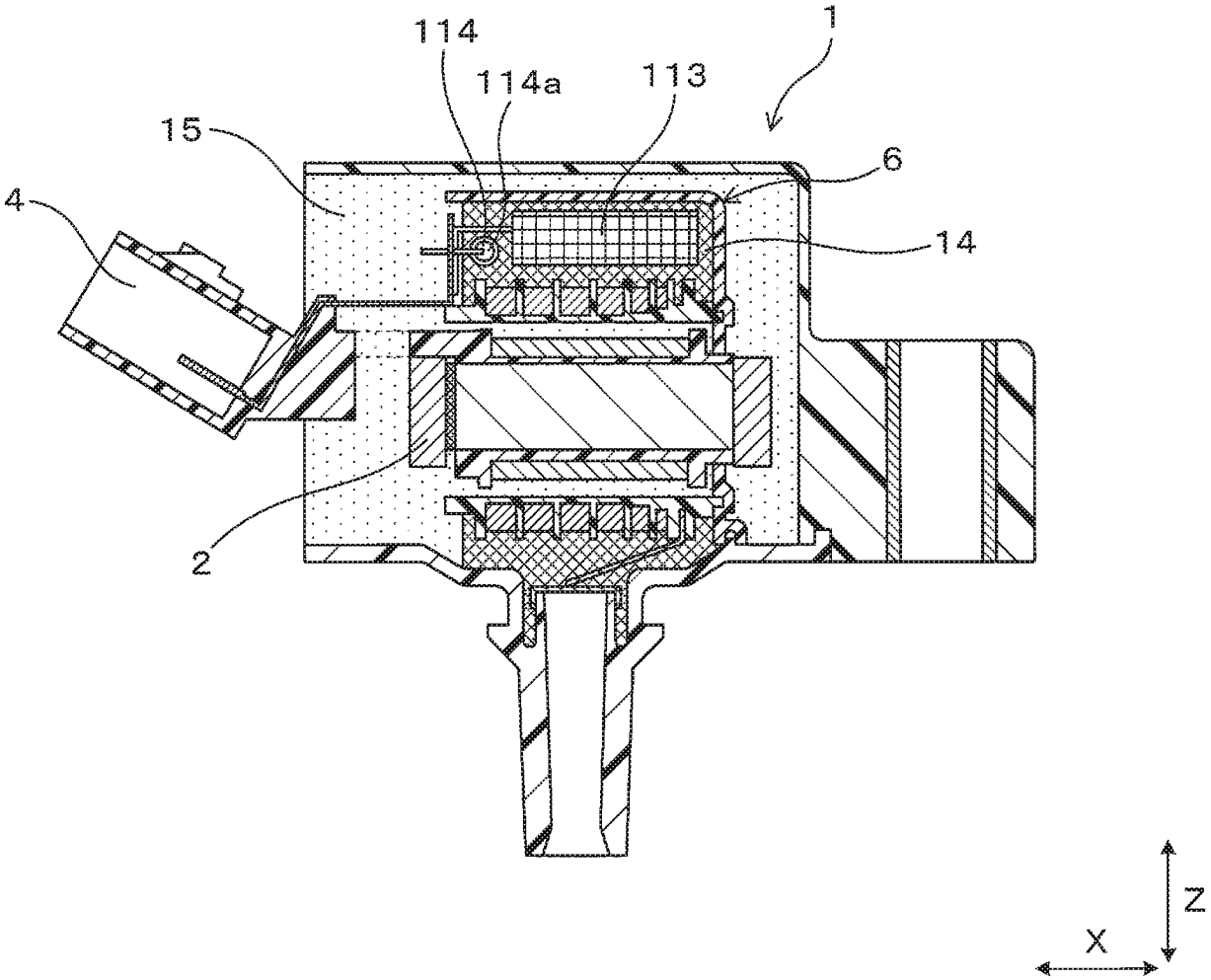
FIG. 11 is a cross sectional diagram of the ignition coil for an internal combustion engine, according to a fourth embodiment.

In the fourth embodiment, a disposed position of the diode 114 is different from the third embodiment, as shown in FIG. 11. In the fourth embodiment, the diode 114 is provided on the inside of the inner case 6. The diode 114 is also buried inside the first filler resin 14. It is noted that in the fourth embodiment, a length wise direction of the diode 114*a* is the horizontal direction Y.

Other aspects of the fourth embodiment are the same as the third embodiment. Also, the same effects of the third embodiment are also obtained in the fourth embodiment.

Fifth Embodiment

Figure 12:
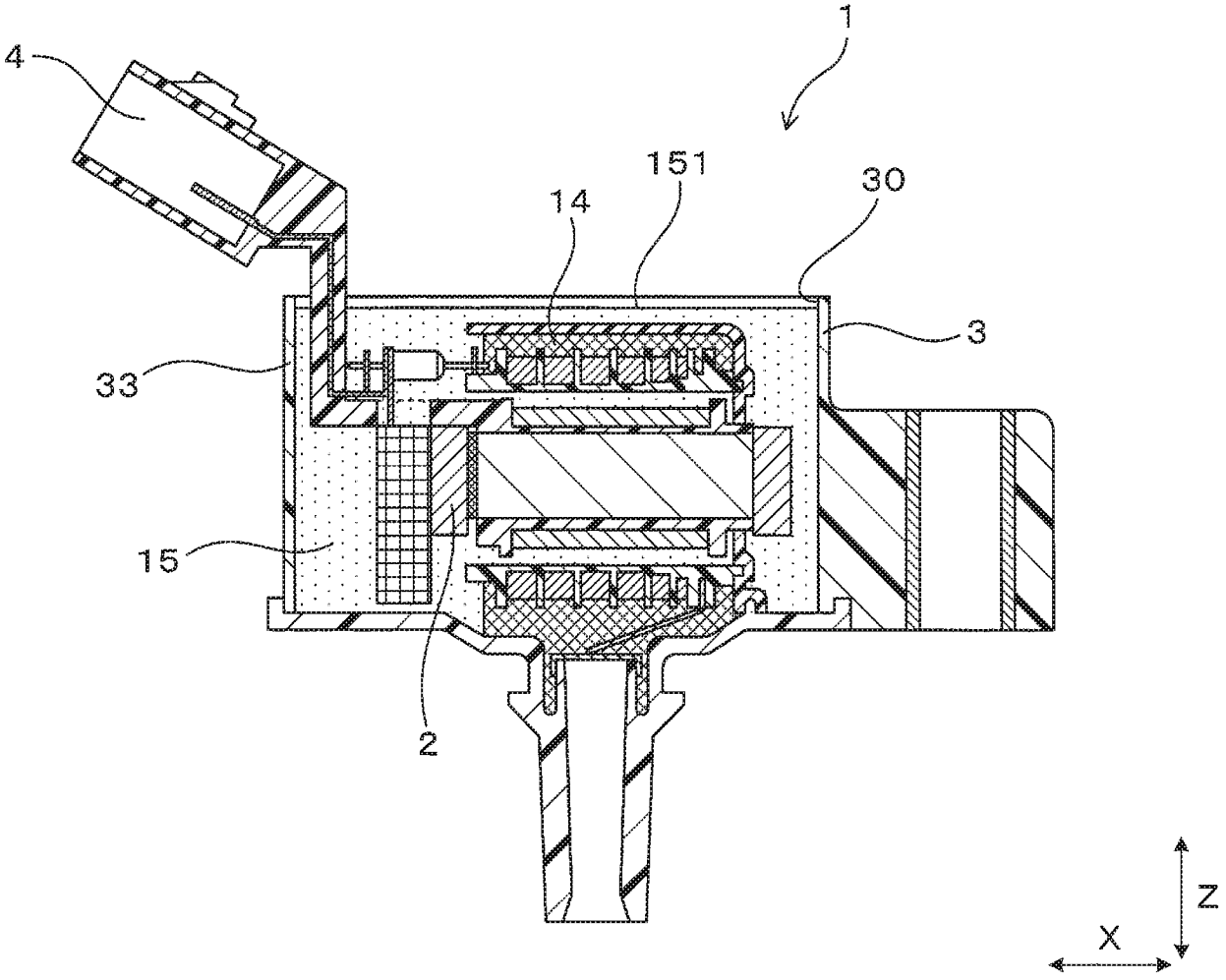
FIG. 12 is a cross sectional diagram of the ignition coil for an internal combustion engine, according to a fifth embodiment.

In a fifth embodiment, a disposed position of the open portion 30 of the case 3 of the first embodiment is different from the first embodiment, as shown in FIG. 12. That is, in the fifth embodiment, the open portion 30 is formed on an upper surface of the case 3. The third case 33 has a rectangular tube shape. The third case 33 is not provided with a third case opposed portion 330, which is shown in FIG. 1, for example, of the first embodiment.

In the fifth embodiment, the exposed surface 151 is a surface which is opposed to the upper side, as shown in FIG. 12. The connector 4 is extended upwardly to the upper side from the exposed surface 151.

Other aspects of the fifth embodiment and effects obtained there-from are the same as the first embodiment.

Sixth Embodiment

Figure 13:
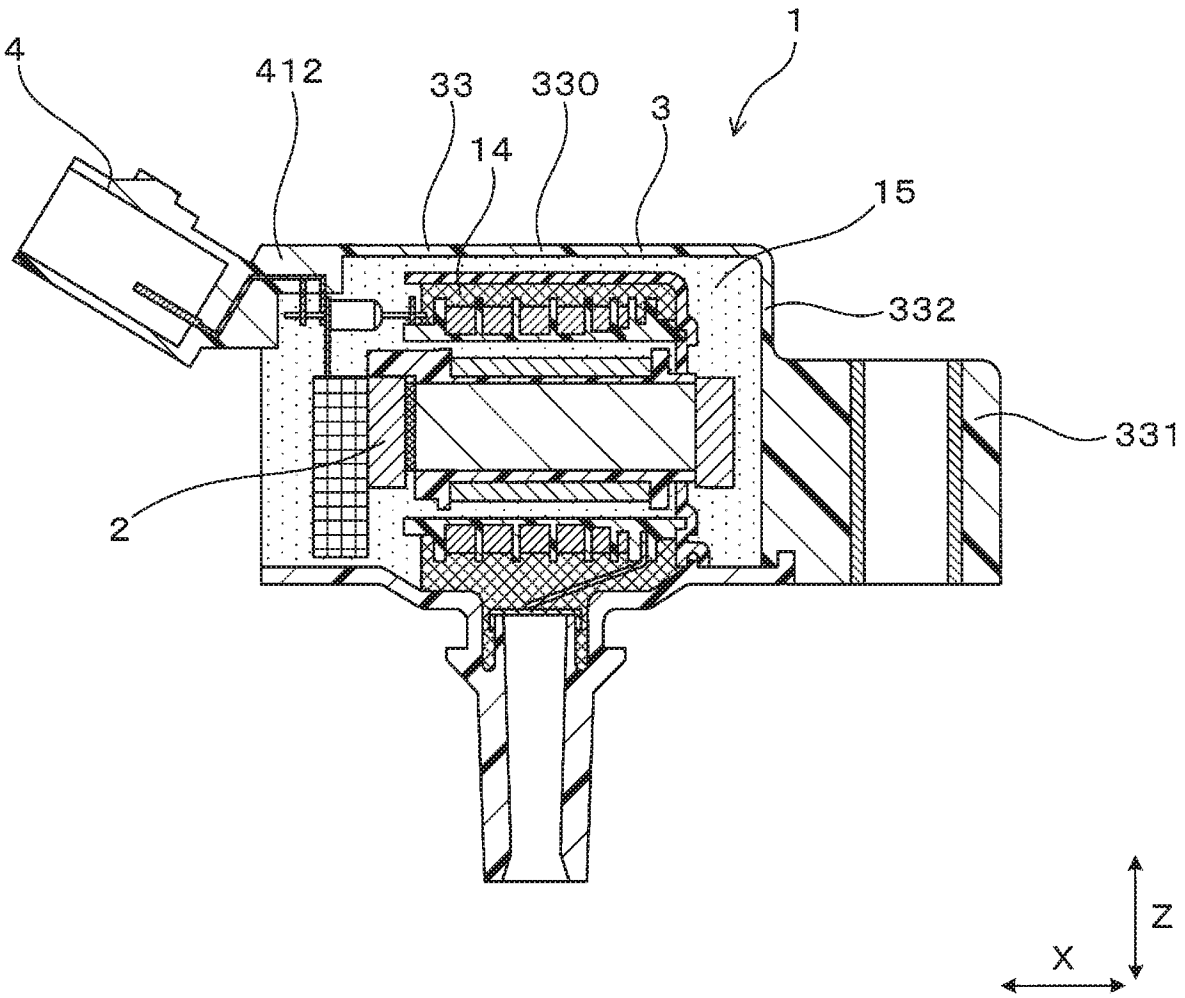
FIG. 13 is a cross sectional diagram of the ignition coil for an internal combustion engine, according to a sixth embodiment.

In a sixth embodiment, the connector 4 and the case 3 are formed as one body, relative to the first embodiment, as shown in FIG. 13. In the sixth embodiment, a front end portion of the third case opposed portion 330 of the third case 33 and the extended portion 412 of the connector 4 are joined. That is, the connector 4 and the third case 33 are form one body. In the sixth embodiment, the third case opposed portion 330 and the third case side-portion 332 are formed to a deformable level of thinness.

Other aspects of the sixth embodiment are the same as the first embodiment.

In the sixth embodiment, when the ignition coil 1 is fixed to the cylinder head at the fixing portion 331, the vibrations of the cylinder head are adsorbed by deformation of the third case 33 and the second filler resin 15 that has close contact with the case 3, before the transmission of the vibrations from the fixing portion 331 to the connector 4. According to this configuration also, the vibration of the connector 4 can be suppressed.

Effects of the sixth embodiment are the same as the first embodiment.

It is to be understood the present disclosure is described based on the afore-mentioned embodiments, however is not limited to the embodiments or structural configurations described above. That is, the present disclosure includes various modified examples modifications within the equivalent ranges. In addition, various combinations and modes which include one element, more than one element or less than one element are included within category and the scope of the disclosure. For example, in the afore-mentioned embodiments, elasticity of the respective first filler resin and the second filler resin is adjusted by a content ratio of the filler, however not limited to that described. That is, a type of resin used in the first filler resin and the second filler resin may also be changed. In this case, an epoxy resin as the first filler resin, and silicone as the second filler resin may be used. Alternatively, the elasticity between the first filler resin and the second filler resin may be adjusted by using an epoxy resin for both the first filler resin and the second filler resin, whilst changing and adjusting a composition of the epoxy resin between the first filler resin and the second filler resin.

Relative to the embodiments described hereinabove, other configuring components that are not mentioned hereinabove may also buried inside the first filler resin or the second filler resin. A configuration in which the power terminal and the earth terminal, among the inner terminals of the connector, are connected and a capacitor which prevents electro-magnetic noise is buried inside the first filler resin or the second filler resin may also be provided.

The position of the open portion of the first case is not limited to the afore-mentioned embodiments, that is, various modes are conceivable. In the first embodiment, for example, a configuration in which the open portion of the case is provided in one direction of the horizontal direction may be considered. In the first embodiment, a configuration that includes the open portion disposed obliquely upwards towards an oblique upper part, for example, is also conceivable.

In each of the afore-mentioned embodiments, a configuration in which the inner case body is provided with an opening that opens towards the front part is exemplified, however, the opening configured is not limited to that described. For example, the inner case body may also be opened upwardly, for example, towards the upper part.

In the sixth embodiment, a configuration in which the third case and the connector are formed as the one body is exemplified, however, the configuration in not limited to the above described. That is, the connector may also be provided as a separate member from the third case. In this case, the connector and the third case can be interlocked with each other, for example, whereby the connector and the case form one body by interlocking thereof.

In the embodiments, the high voltage output section is a high voltage output terminal formed from metal, however it is not limited to the configuration described. That is, the high voltage output section may also be a resistance body that suppresses current noise from a spark plug connected to the ignition coil.

The invention claimed is:

1. An ignition coil for an internal combustion engine comprising:

a primary coil;

a secondary coil which is wound around a secondary spool being disposed on an outer peripheral side of the primary coil;

a center core which is disposed on an inner peripheral side of the primary coil and the secondary coil;

an outer core which is disposed on an outer peripheral side of the primary coil and the secondary coil;

a high voltage output section outputting a voltage from the secondary coil to an outside and having conductivity; and a case accommodating the primary coil, the secondary coil, the secondary spool, the center core, the outer core and the high voltage output section, a first filler resin which is filled in parts of an inside of the case, and covers at least the outer peripheral side of the secondary coil that is wound around the secondary spool;

a cover sealant which includes the primary coil, the secondary spool, the secondary coil, the center core and the first filler resin;

a second filler resin which is filled inside the case and seals the cover sealant; and a connector protruding towards an outside of the case, wherein, the case includes a fixing portion being fixed to an internal combustion engine, and the second filler resin covers the outer core and has a lower elasticity than the first filler resin;

the case includes an opening portion which is open to a side which is different from another side on which the fixing portion is disposed:

the second filler resin includes an exposed surface which is exposed towards the outside of the case; and the connector protrudes from the exposed surface.

2. The ignition coil for an internal combustion engine according to claim 1, wherein the exposed surface is formed around a whole peripheral area of the connector.

3. The ignition coil for an internal combustion engine according to claim 1, further comprising a primary spool onto which the primary coil is wound, wherein the connector and the primary spool are formed as one body.

4. The ignition coil for an internal combustion engine according to claim 1, wherein the connector extends from a side which is opposed to the other side provided with the fixing portion disposed.

5. The ignition coil for an internal combustion engine according to claim 1, wherein the second filler resin and the first filler resin each contain a thermosetting resin and a filler which has a smaller linear expansion coefficient than the thermosetting resin, and the second filler resin has a lower filler content ratio than the filler content ratio of the first filler resin.

6. The ignition coil for an internal combustion engine according to claim 1, wherein the case includes a first case covering, from a lower side, components accommodated inside the case;

a second case that, in co-operation with a part of the first case, accommodates the secondary spool, the secondary coil, and the first filler resin, and;

a third case that, in co-operation with the first case, accommodates the primary coil, the secondary coil, the first filler resin, the center core, the outer core, and the second filler resin.

7. The ignition coil for an internal combustion engine according to claim 6, wherein the fixing portion is formed on the third case, the third case and the cover sealant are separated from each other, and the second filler resin is disposed between the third case and the cover sealant.

8. The ignition coil for an internal combustion according to claim 1, wherein the high voltage output section is a high voltage output terminal formed from a metal, which covers an open hole penetrating from the inside to the outside of the case.

9. A manufacturing method of an ignition coil for an internal combustion engine according to claim 1, wherein the first filler resin is filled inside the case, and the second filler resin is filled inside the case after the first filler resin is cured.

10. The ignition coil for an internal combustion engine according to claim 1, further comprising a primary spool onto which the primary coil is wound, wherein the connector and the primary spool are formed as one body.

11. The ignition coil for an internal combustion engine according to claim 1, wherein the connector extends from a side which is opposed to the other side provided with the fixing portion disposed.

12. The ignition coil for an internal combustion engine according to claim 2, wherein the connector extends from a side which is opposed to the other side provided with the fixing portion disposed.

13. The ignition coil for an internal combustion engine according to claim 1, wherein the second filler resin and the first filler resin each contain a thermosetting resin and a filler which has a smaller linear expansion coefficient than the thermosetting resin, and the second filler resin has a lower filler content ratio than the filler content ratio of the first filler resin.

14. The ignition coil for an internal combustion engine according to claim 2, wherein the second filler resin and the first filler resin each contain a thermosetting resin and a filler which has a smaller linear expansion coefficient than the thermosetting resin, and the second filler resin has a lower filler content ratio than the filler content ratio of the first filler resin.

15. The ignition coil for an internal combustion engine according to claim 1, wherein the case includes a first case covering, from a lower side, components accommodated inside the case;

a second case that, in co-operation with a part of the first case, accommodates the secondary spool, the secondary coil, and the first filler resin, and;

a third case that, in co-operation with the first case, accommodates the primary coil, the secondary coil, the first filler resin, the center core, the outer core, and the second filler resin.

16. The ignition coil for an internal combustion engine according to claim 2, wherein the case includes a first case covering, from a lower side, components accommodated inside the case;

a second case that, in co-operation with a part of the first case, accommodates the secondary spool, the secondary coil, and the first filler resin, and;

a third case that, in co-operation with the first case, accommodates the primary coil, the secondary coil, the first filler resin, the center core, the outer core, and the second filler resin.

17. The ignition coil for an internal combustion according to claim 1, wherein the high voltage output section is a high voltage output terminal formed from a metal, which covers an open hole penetrating from the inside to the outside of the case.

18. The ignition coil for an internal combustion according to claim 2, wherein the high voltage output section is a high voltage output terminal formed from a metal, which covers an open hole penetrating from the inside to the outside of the case.

19. A manufacturing method of an ignition coil for an internal combustion engine according to claim 1, wherein the first filler resin is filled inside the case, and the second filler resin is filled inside the case after the first filler resin is cured.

* * * * *